US006027322A

United States Patent [19]

Ferentinos et al.

[11] Patent Number: 6,027,322

[45] Date of Patent: Feb. 22, 2000

[54] METHOD AND APPARATUS FOR ADJUSTING THE ROTORS OF A ROTARY SCREW COMPRESSOR

[75] Inventors: James T. Ferentinos, Spanish Fort, Ala.; Richard W. Kirkland, Forth Worth, Tex.; Ronald N. Smith, Daphne, Ala.

[73] Assignee: Coltec Industries Inc, Charlotte, N.C.

[21] Appl. No.: 08/960,388

[22] Filed: Oct. 29, 1997

[51] Int. Cl.[7] ..... F03C 2/00

[52] U.S. Cl. ..... 418/1; 418/109

[58] Field of Search ..... 418/1, 109, 201.1

[56] References Cited

U.S. PATENT DOCUMENTS 2,262,552 11/1941 Lyon ..... 418/109 X
4,464,976 8/1984 Tyler ..... 418/201.1 X

*Primary Examiner*—Hoang Nguyen
*Attorney, Agent, or Firm*—Cummings & Lockwood

[57] ABSTRACT

A rotor adjusting apparatus for adjusting flank clearance between the lands of meshing first and second rotors in a positive displacement screw machine is disclosed which includes a base configured to mount proximate an end of the meshing first and second rotors in the screw machine. A locking mechanism is supported by the base and operatively configured for locking the first rotor shaft in a fixed position relative to the base. An adjusting bar is configured to attach to the second rotor shaft for rotational adjustment thereof in relation to the first rotor to establish clearance between the land flanks of the meshing first and second rotors. A measuring tool is adjustably mounted to the base permitting measurement of rotational adjustment of the adjusting bar. A second locking mechanism is supported by the base and operatively configured for locking the adjustment bar in a fixed position in relation to the base and, thereby, the second rotor in relation to the first rotor.

22 Claims, 3 Drawing Sheets

METHOD AND APPARATUS FOR ADJUSTING THE ROTORS OF A ROTARY SCREW COMPRESSOR

BACKGROUND OF THE INVENTION

1. Field of the Invention

The present invention relates to the adjustment of oil-less positive displacement rotary screw compressors. More particularly, the present invention provides a new method and apparatus for accurately adjusting the flank clearances between the rotors of oil-less positive displacement rotary screw compressors.

2. Background of the Related Art

Rotary screw compressors are used in numerous industries to provide a supply of compressed air for supporting applications such as automatic machines, tools, material handling devices, and food processing equipment. In comparison to the predominate reciprocating-piston type compressor, rotary screw compressors operate more efficiently and at a lower compressor specific power, providing small capacities at high pressures. Other advantages include reduced space requirements and lower vibration levels. Two types of rotary screw compressors are oil-injected and oil-less.

The oil-injected type rotary screw compressor includes a casing with two intersecting bores having parallel axes, an inlet port adjacent one endwall, and a compressed air outlet port adjacent another endwall. Disposed within the bores are a pair of meshing rotors—each rotor having helical lands and intervening grooves with a wrap angle of less than 360°. The leading and trailing faces of each land form leading and trailing flanks. Minimal clearances are maintained between the rotors and the end walls and bores of the casing. One rotor is a male rotor type, i.e., a rotor having at least the major portions of its lands and grooves disposed outside the pitch circle of the rotor. The other rotor is a female rotor type, i.e., a rotor having at least the major portions of its lands and grooves disposed inside the pitch circle of the rotor. The lands of one rotor follow the envelopes developed by the grooves of the other rotor to form a continuous sealing line there between. Chambers are formed between the sealing line, land tops, casing end walls and bores. One of the rotors is driven by a motor while the other rotor is driven by the first.

In operation, a gaseous fluid is displaced and compressed within the chambers from the inlet port to the outlet port of the compressor. Three phases make up this process: a filling phase, a compression phase, and a discharge phase. During the filling phase each compression chamber communicates with the air inlet port, during the compression phase the chamber undergoes a continued reduction in volume, and during the discharge phase the chamber communicates with the compressed air outlet port.

Because the flanks of the rotors of the above described screw compressor are in meshing contact with one another, oil must be injected into the compressor to prevent excessive contact wear which would ultimately lead to premature failure of the compressor. Oil-injected systems, however, have several drawbacks. Although the contact wear is substantially reduced due to the lubricating film, it is not eliminated. Also, the injected oil necessarily passes into the air system that is being supplied by the compressor. Oil separation units can be included in the compressed air line to substantially reduce the quantity of oil that enters the air line, however the separation units never completely eliminate it. In certain applications, such as food processing equipment and hospital air systems, even traces of oil bypass is impermissible.

To eliminate the problems associated with oil-injected systems, oil-less type rotary screw compressors have been developed. The essential difference between oil-injected and oil-less air compressors is that the male and female rotors of oil-less systems are timed so they do not come into contact with each other during operation. In other words, total backlash between the rotors is proportioned, not necessarily equally, between the male rotor leading flank and female rotor trailing flank, and the male rotor trailing flank and female rotor leading flank. Rotor timing is typically provided by either helical or spur gears having pitch circles matching the pitch circles of their respective rotors.

During assembly, overhaul, and periodically during the maintenance of oil-less compressors, the rotors must be properly adjusted and their gears set to ensure the proper clearance between the rotor flanks. Improper clearance settings can cause poor compressor performance, excessive operating noise, or even destructive failure of the compressor. The amount of rotor clearance depends on the compressor design and, therefore, must be determined by the manufacturer of each compressor. Rotor clearance adjustments must be made after the compressor has been assembled but prior to operation.

Presently, a technician sets rotor clearance by inserting a feeler gauge between the flanks of a set of rotor lands and adjusting the rotors to the predetermined clearance. Access to the rotors is gained by reaching through either the inlet port or the outlet port. The timing gears are then adjusted and secured to retain the gauged setting.

There are numerous disadvantages associated with the above method of rotor adjustment. The inlet and outlet ports are small, therefore making it very difficult to accurately insert the feeler gauges between the rotor lands. Also, even if ready access could be had, it is difficult to accurately locate the feeler gauge at the exact point of flank contact between the rotors. Additionally, once the feeler gauges are positioned between the rotor lands and the rotors are rotated to the gauged setting, it is difficult to maintain the rotor relationship while adjusting and securing the timing gears in position. This later step usually requires a second technician's assistance. Because of the above disadvantages, rotor adjustments must be made by experienced technicians and, even then, takes a great deal of time and care to properly accomplish.

Clearly there is a need in the art for a method and an apparatus to accurately and easily adjust and set the flank clearance between the rotors of a rotary screw compressor. Preferably, the method should be able to be performed and the apparatus utilized externally to the compressor casing. In addition, the method and apparatus should permit the user to clamp the gauged rotors firmly in place while fastening the timing gears. Finally, successful use of the method and apparatus should not be dependent on the experience of the technician charged with adjusting and setting the rotor flank clearance.

SUMMARY OF THE INVENTION

The subject invention, described hereinbelow, eliminates the disadvantages exhibited in the prior art by utilizing a novel method and apparatus for adjusting the rotors of an oil-less rotary screw compressor.

Rotary screw compressors include a rotor casing with an air intake opening and an air exhaust opening on opposite ends of the casing. Two intersecting rotor bores extend through the casing which form two rotor barrels in which a male and female rotor are located. The male and female rotors include oppositely threaded helical lands and are in meshing relationship. Each land includes a leading flank and trailing flank. There are no seals between the rotor lands and the casing bores, therefore clearances between these components are kept to a minimum so to provide optimal compressor efficiency. In addition, there is a minimal amount of total backlash between the male and female helical lands.

A compressor drive motor drives the male rotor through a male rotor shaft extending from the intake side of the compressor. A first timing gear having a pitch diameter equal to that of the male rotor's pitch diameter is fastened to the exhaust end of the male rotor. A second timing gear having a pitch diameter equal to that of the female rotor's pitch diameter is adjustably fastened to the exhaust end of the female rotor. The male rotor timing gear is in meshing relationship with the female rotor timing gear and thereby drives the female rotor. Once adjusted, clearance between the male and female rotor land flanks remains constant. Each screw compressor has its own optimal rotor flank clearance which depends on the casing and rotor design. Optimal flank clearance for each compressor is determined by the manufacturer of each compressor through simulation and empirical testing.

In accordance with a preferred embodiment of the subject invention, the rotor adjusting apparatus includes a base plate having one surface for attachment to the inlet end of the screw compressor and an opposing second surface having several attachment points for attachment of components that will be described presently. Clearance holes are formed in the base plate through which the shafts of the male and female rotor extend. A first locking bolt bracket having two threaded holes whose axes lie coincident is fastened to the second surface of the base plate. A first set of locking bolts is threaded through the axially coincident threaded holes and are hand adjustable to create a clamping action between them. A channel bar is rigidly fastened to the end of the female rotor shaft and is prevented from rotating by causing the first set of locking bolts to clamp against the flanges of the channel bar.

A second locking bolt bracket also having two threaded holes whose axes lie coincident is fastened to the second surface of the base plate and in parallel relationship with the first locking bolt bracket. A second set of locking bolts is threaded through the axially coincident threaded holes and are hand adjustable to create a clamping action between them.

A ring portion of an adjusting bar is fastened to the intake end of the male rotor shaft by the tightening of a set screw threaded through the ring portion and against the outer diameter of the shaft. A bar portion of the adjusting bar extends between the second set of locking bolts and between the flanges of the clamped channel bar. Because of the backlash between the male and female rotors, the male rotor along with the adjusting bar can rotate somewhat. The adjusting bar is lockable in position by clamping the second set of locking bolts against the bar portion of the adjusting bar.

A bracket is adjustably fastened to the second locking bolt bracket. A dial indicator is adjustably fastened to the bracket and can be positioned so its probe rests against the bar portion of the adjusting bar allowing measurement of the rotational movement of the bar.

In operation, the rotors are adjusted to set the flank clearance between the rotor lands by first loosening the female timing gear fastened to the female rotor. The female rotor is then locked in position by tightening the first set of locking bolts against the channel bar. Total rotor backlash between the male and female rotors is then determined by rotating the male rotor to one extreme, adjusting the dial indicator so its probe rests against the bar portion of the adjusting bar, adjusting the dial indicator bezel to read zero, and then rotating the male rotor to the other extreme and noting the new dial indicator reading. The desired flank clearance adjustment is then calculated based on the screw compressor manufacturer's specifications. The male rotor is then adjusted to the desired flank clearance by rotating the second set of locking bolts. Finally, the female timing gear is adjusted to maintain the clearance adjustment and fastened in position.

It should be noted that the proper clearance can be calculated and made between either the male rotor trailing flanks and female rotor leading flanks or the male rotor leading flanks and female rotor trailing flanks. As long as the correct specification is used for the method of adjustment, the results will be the same.

Although the below description details the method and apparatus for adjusting the rotors in a rotary screw compressor, it is readily understood by those skilled in the art that the method and apparatus can be utilized on a rotary screw expansion machine or any other intermeshing rotary device which requires timing of the rotating members.

BRIEF DESCRIPTION OF THE DRAWINGS

So that those having ordinary skill in the art to which the subject invention appertains will more readily understand how to carry out the steps of the method, and make and use the apparatus for adjusting the rotors of a screw compressor described herein, a preferred embodiment of the invention will be described in detail hereinbelow with reference to the drawings wherein.

DETAILED DESCRIPTION OF THE PREFERRED EMBODIMENTS

Figure 1:
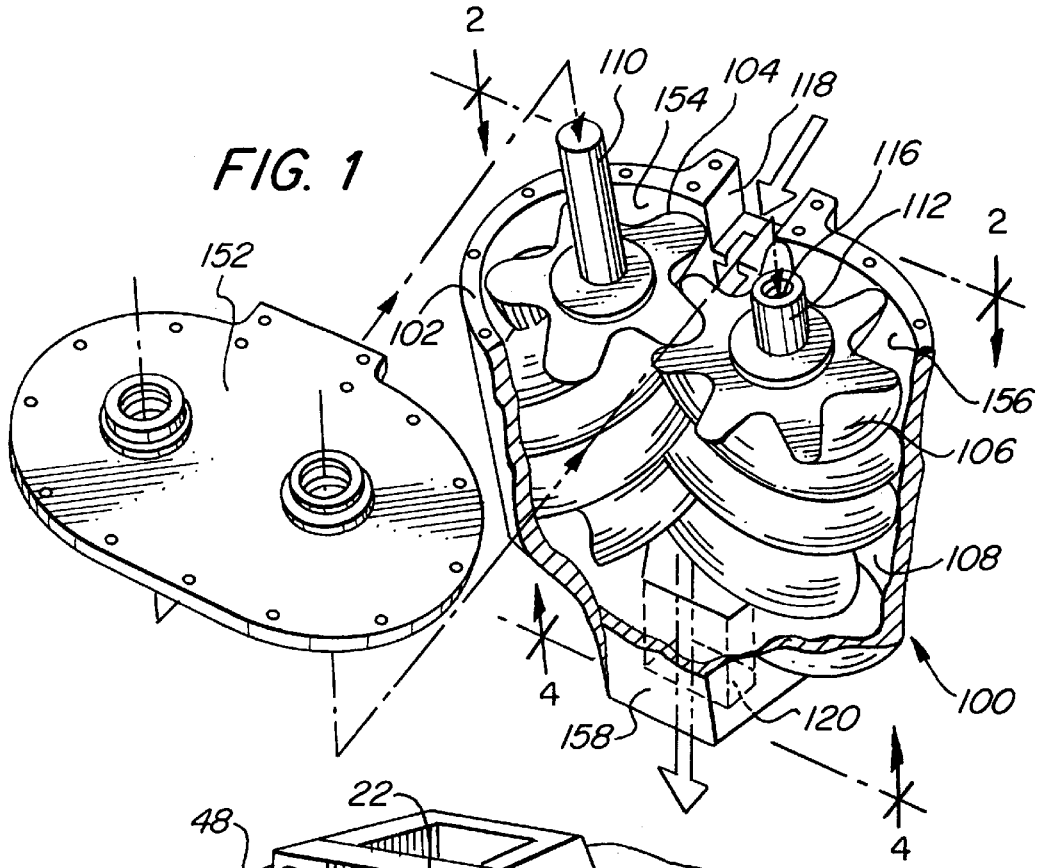
FIG. 1 is a perspective view of a screw compressor with its casing partially cut away and its intake end cover separated for ease of illustration.

Referring now to the drawings wherein like reference numerals identify similar structural elements of the subject invention, there is illustrated in FIG. 1 a rotary screw compressor 100 with its rotor casing 102 partially cut away and its intake end cover 152 separated for ease of illustration. As will be better understood from the description provided herein below, rotary screw compressors are a positive displacement type compressor.

Figure 2:
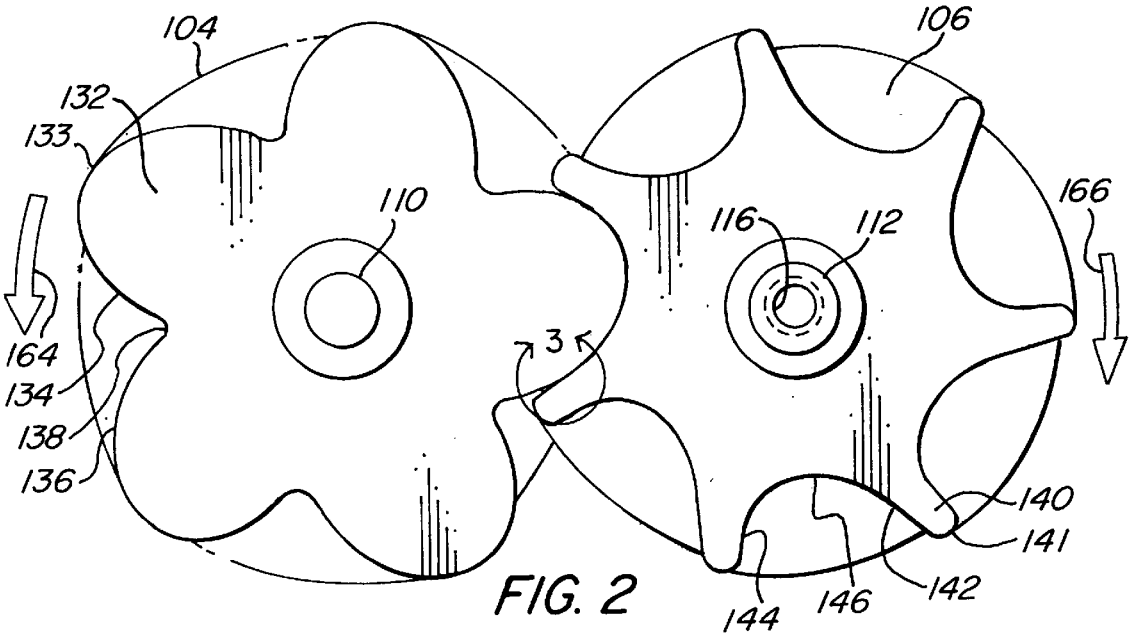
FIG. 2 is an elevational view of the screw compressor as viewed along line 2—2 of FIG. 1 with its casing removed.
Figure 4:
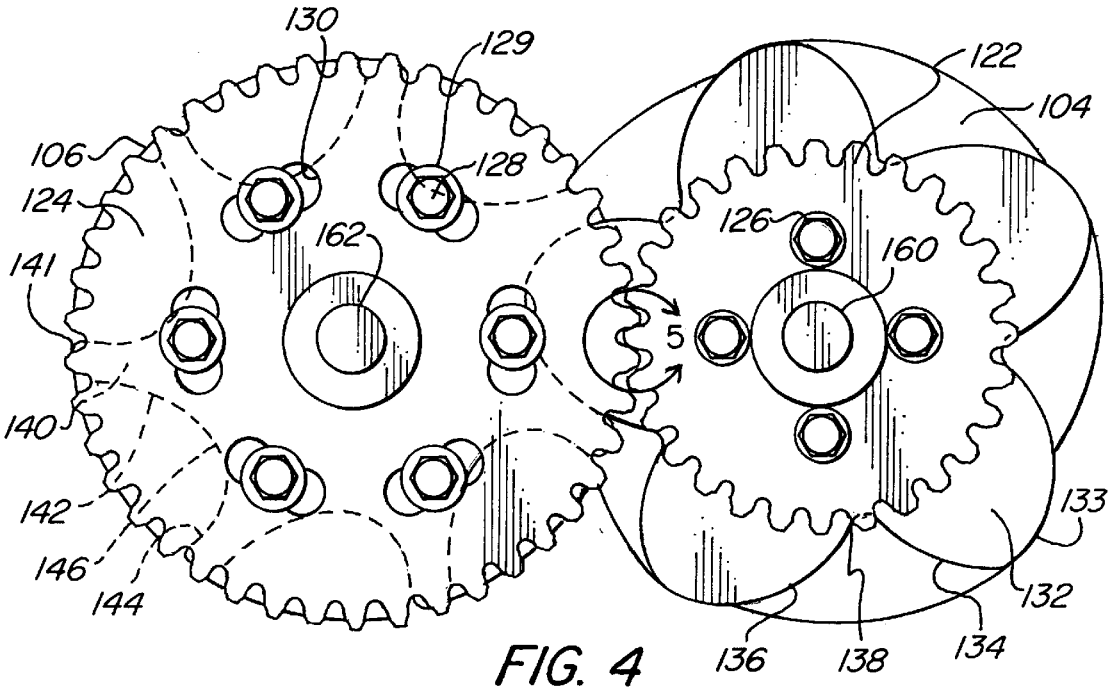
FIG. 4 is an elevational view of the screw compressor as viewed along line 4—4 of FIG. 1 with its casing and exhaust cover removed, illustrating the relationship between the rotors and timing gears.

Referring to FIGS. 1, 2, and 4, the screw compressor 100 includes a rotor casing 102 with an air intake opening 118 on the intake side of the compressor and a compressed air exhaust 120 on the exhaust side of the compressor. In the casing 102, two intersecting rotor bores 154 and 156 are provided forming two rotor barrels in which a male rotor 104 and female rotor 106 are located. The male rotor 104 has right hand helical lands 132 defined thereon and has its intake end shaft 110 and exhaust end shaft 160 supported by bearings (not shown) housed in the intake end cover 152 and exhaust end cover 158, respectively. The female rotor 106 has left hand helical lands 140 defined thereon and also has its intake end shaft 112 and exhaust end shaft 162 supported by bearings (not shown) housed in the intake end cover 152 and exhaust end cover 158, respectively. A threaded hole 116 is formed into the end of the female rotor intake end shaft 112 for a purpose to be describe hereinbelow.

The male and female rotors 104 and 106 are in meshing relationship. In the illustrated compressor, the male rotor 104 has five (5) helical lands 132. Each land 132 includes a leading flank 134, trailing flank 136, and land top portion 133. Between each set of male helical lands is a groove 138. The female rotor 106 has seven (7) helical lands 140. Each land 140 includes a leading flank 142, trailing flank 144, and land top portion 141. Between each set of female helical lands is a groove 146. There is a minimal amount of backlash between the rotor land flanks. Backlash is defined here as the space between the thickness of a rotor land and the width of the space between rotor lands in the mating rotor. Backlash is required to prevent binding between the rotors due to heat expansion, eccentricity, and manufacturing inaccuracies. In rotary screw compressors, backlash is controlled by the geometry of each rotor design and the center-to-center distance between the rotors. Because the rotors must also fit concentrically in the rotor bores very stringent tolerancing is necessary.

Referring in particular to FIG. 2, the male rotor air intake shaft 110 is driven by a compressor drive motor (not shown) in the counter-clockwise direction, as indicated by directional arrow 164. The female rotor 106 is driven by the male rotor 104 in the clockwise direction, as indicated by direction arrow 166.

Now referring in particular to FIG. 4, a male rotor timing gear 122 is bolted to the exhaust end of the male rotor 104 by a plurality of locking bolts 126 which extend through corresponding apertures in the gear 122. A second timing gear 124 is bolted to the exhaust end of the female rotor 106 by a plurality of locking bolts 128 and washers 129 which extend through arcuate apertures 130 in the gear 124. The male timing gear 122 and female timing gear 124 are in meshing relationship with each other.

In operation, air is drawn into the compressor through the air intake 118 as the rotors of the compressor rotate. A predetermined volume of air is captured within the exposed grooves 138 and 146 of each set of helical lands, the rotor casing 102, and the intake end cover 152 and the exhaust end cover 158. As the male rotor 104 and female rotor 106 mesh, the volume of captured air is compressed until the trailing end of each groove opens to the air exhaust 120. Compressor efficiency is increased as the clearance between the rotors 104 and 106, the casing 102, and the end covers 152 and 158 is decreased.

Figure 6:
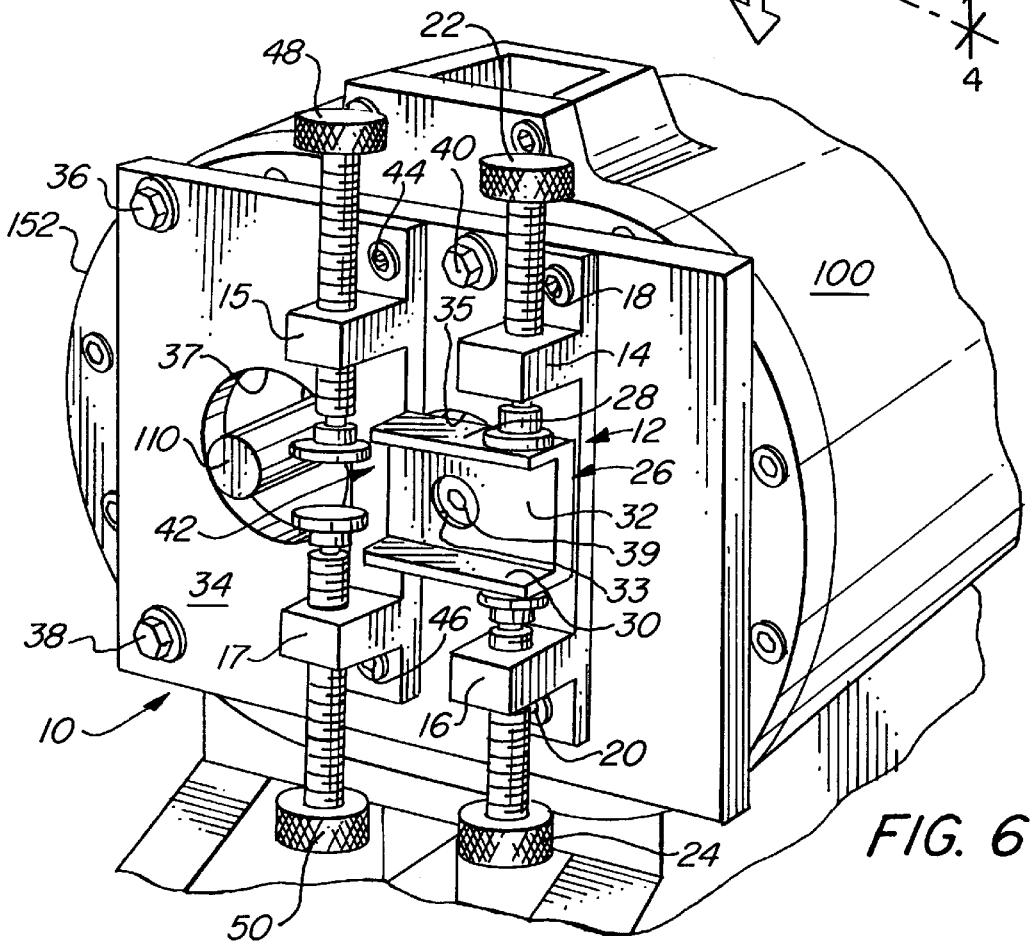
FIG. 6 is a perspective view showing a preferred embodiment of the subject invention assembled to the intake end of a rotary screw compressor with the adjusting bar, dial indicator, dial indicator adjusting lever, and dial indicator attachment bracket removed for ease of illustration.
Figure 7:
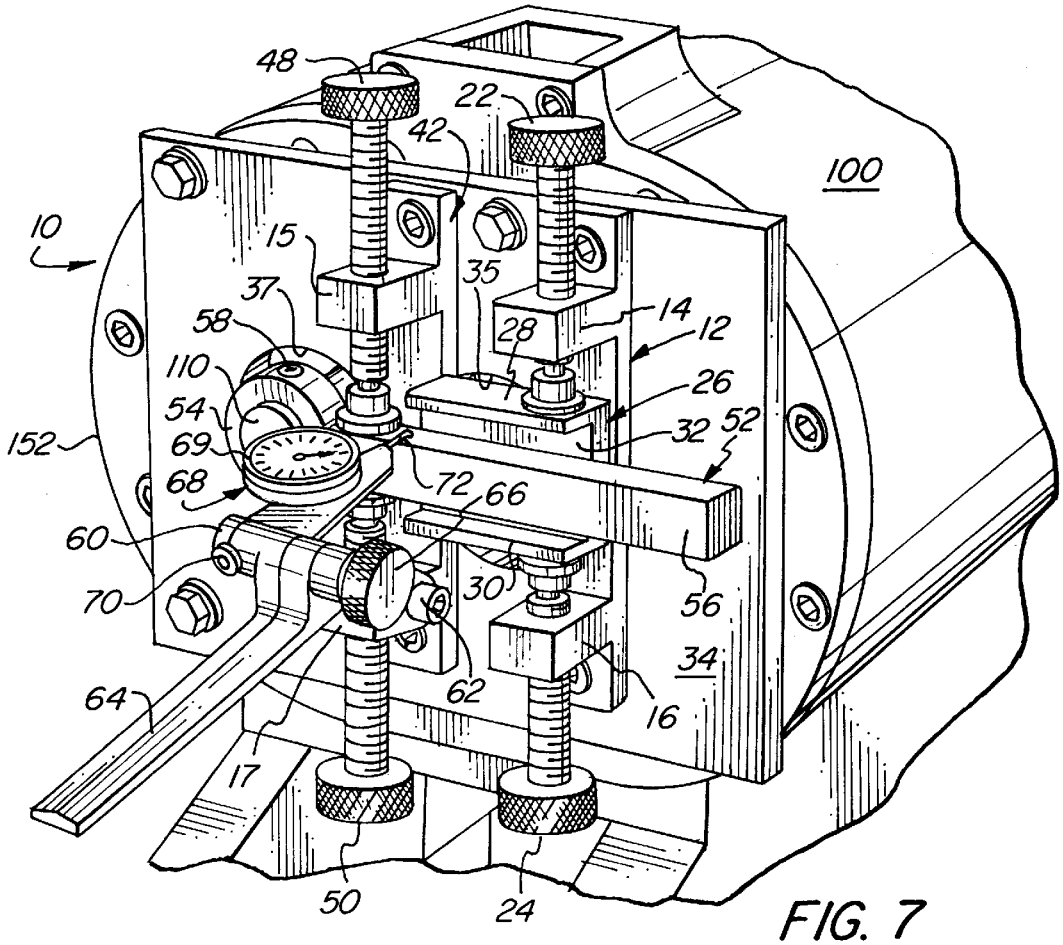
FIG. 7 is a perspective view showing a preferred embodiment of the subject invention assembled to the intake end of a rotary screw compressor.

Referring now to FIGS. 6 and 7, a preferred embodiment of the apparatus for adjusting the rotors of the type of screw compressor described hereinbefore is designated generally by reference numeral 10. The air intake end of a rotary screw compressor 100 is shown. The compressor 100 includes the intake end cover 152 which is bolted to the intake end of the compressor 100. The adjusting apparatus 10 includes a base plate 34 that is bolted to the intake end cover 152 with a plurality of attachment bolts 36, 38, and 40. A male rotor shaft throughhole 37 and female rotor shaft access hole 35 are provided in plate 34.

Referring now in particular to FIG. 6, a first locking bolt bracket 12 is attached to base plate 34 by two screws 18 and 20. The first bracket 12 includes upper and lower threaded flanges 14 and 16. The axes of the threaded holes in each flange are coincident. Upper and lower knurled locking bolts 22 and 24 are threaded through the upper and lower threaded flanges 14 and 16, respectively. The knurled locking bolts 22 and 24 may be threadingly adjusted to vise a body between them. A second locking bolt bracket 42 is fastened to the plate 34 by two screws 44 and 46. The second bracket 42 is in parallel relationship to the first bracket 12. The second locking bolt bracket 42 also includes upper and lower threaded flanges 15 and 17. The axes of the threaded holes in each of these flanges are also coincident. Upper and lower knurled locking bolts 48 and 50 are threaded through the upper and lower threaded flanges 15 and 17, respectively. The knurled locking bolts 48 and 50 may be threadingly adjusted to vise a body between them.

With continuing reference to FIG. 6, a channel bar 26 is fastened to the threaded hole 116 in the female rotor intake end shaft 112 by a bolt 39 that passes through a counter bored hole 33 in the channel 26 and the female rotor access hole 35 in the base plate 34. The female rotor 106 is locked into position, i.e., prevented from moving axially or rotating, by adjusting the two knurled locking bolts 22 and 24 that are threaded into the first locking bolt bracket 12 against the upper and lower flanges 28 and 30 of the channel bar 26.

Referring now to FIG. 7, an adjusting bar 52 is secured to the male rotor intake end shaft 110 by a set screw 58 that is threaded through the ring portion 54 of the adjusting bar 52 and locked against the outside diameter of the shaft 110. The arm portion 56 of the adjusting bar 52 lies within, but does not contact the walls of the channel formed by the upper flange 28, lower flange 30, and web 32 of the channel bar 26. This clearance allows the adjusting bar to have some rotational freedom to allow adjustment of the male rotor to the female rotor for reasons that will be more fully described hereinbelow.

For the preferred embodiment described herein, the channel bar 26 is fastened to the female rotor intake end shaft 112 and the adjusting bar 52 is fastened to the male rotor intake end shaft 110. If so dictated by the configuration of the screw compressor being adjusted, a preferred embodiment can alternatively provide for the channel bar 26 to be fastened to the male rotor intake end shaft 110 and the adjusting bar 52 to be fastened to the female rotor intake end shaft 112. Doing so would not stray from the concepts taught by the disclosed invention.

With continuing reference to FIG. 7, a dial indicator attachment bracket 60 is attached to the lower threaded flange 17 of the second locking bolt bracket 42 with a screw 62. The bracket 60 has a generally 'H' shape but may alternately be formed from two links. A dial indicator adjusting lever 64 is adjustably attached to the indicator bracket 60 with a threaded knob 66. A dial indicator 68 is adjustably attached to the lever 64 with a screw 70. The dial indicator attachment bracket 60, adjusting lever 64, and dial indicator 68 are sufficiently adjustable so that a dial indicator probe 72 can contact the top surface of the arm portion 56 of the adjusting bar 52 throughout the adjusting bars limited rotation. The dial indicator 68 should be of the type capable of measuring 0.0001 inch (0.00254 mm) and for convenience may have an adjustable bezel 69 for adjusting the bezel to the zero inch (mm) reading.

Adjustment of the male rotor 104 to the female rotor 106 using the preferred embodiment of the present invention requires that the male rotor intake end shaft 110, the threaded hole 116 and end portion of the female rotor intake end shaft 112, and the timing gears 122 and 124 are readily accessible. The adjusting apparatus 10 is installed as described above and illustrated in FIGS. 6 and 7. Rotor adjustment is made following the steps described hereinbelow.

Initially, referring to FIG. 4, the plurality of female rotor timing gear locking bolts 128 are loosened so that the female rotor timing gear 124 adjustingly slips in relation to the female rotor 106. Then, as shown in FIGS. 2 and 7, with the female rotor 106 locked into position, the adjusting bar 52 is rotated in a counter-clockwise direction until it stops. In this position, the leading flanks 134 of the male rotor 104 are in contact with the trailing flanks 144 of the female rotor 106. Thereafter, the male rotor 104 is locked in this position by adjusting the knurled locking bolt 50 threaded into the lower threaded flange 17 of the second locking bolt bracket 42 against the bottom surface of the arm portion 56 of the adjusting bar 52. Then, the dial indicator 68 is adjusted so that the indicator probe 72 rests on the top surface of the adjusting bar arm portion 56 and causes the dial to rotate several one-thousandths of an inch. The dial indicator 68 is then secured in this position. Thereafter, the dial indicator bezel 69 is adjusted to read zero.

Subsequently, the knurled locking bolt 50 is loosened and the adjustment bar 52 rotated in a clockwise direction until it stops. In this position, the trailing flanks 136 of the male rotor 104 are in contact with the leading flanks 142 of the female rotor 106. Then, the male rotor 104 is locked in this position by adjusting the knurled locking bolt 48 threaded into the upper threaded flange 15 of the second locking bolt bracket 42 against the top surface of the adjusting bar arm portion 56 of the adjusting bar 52.

At such time, the total rotor backlash is obtained by observing the new reading from the dial indicator 68. Total rotor backlash is then multiplied by the decimal representing the percent of backlash desired between the male rotor trailing flank 136 and the female rotor leading flank 142, and the result is noted by the technician. This number is referred to hereinafter as the 'trailing flank clearance'. The dial indicator bezel 69 is then readjusted to a zero reading.

Figure 3:
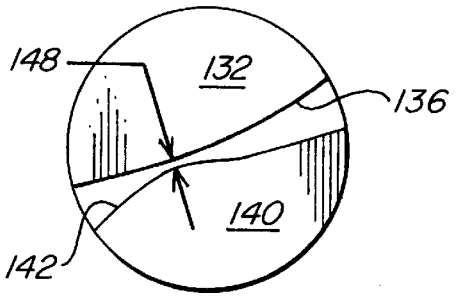
FIG. 3 is an enlarged localized view taken from FIG. 2 illustrating trailing flank clearance between the male rotor trailing flank and the female rotor leading flank.

The upper knurled locking bolt 48 threaded into the upper threaded flange 15 of the second locking bolt bracket 42 is then loosened and the lower knurled locking bolt 50 is slowly adjusted to cause the adjusting bar 52 to rotate in a counter-clockwise direction. Adjustment of the lower knurled locking bolt 50 is complete when the dial indicator 68 reads the above calculated trailing flank clearance. The upper knurled locking bolt 48 is then tightened so to retain the adjustment that has been established. FIG. 3 shows the trailing flank clearance 148 between the trailing flank 136 of the male rotor land 132 and the leading flank 142 of the female rotor land 140.

Figure 5:
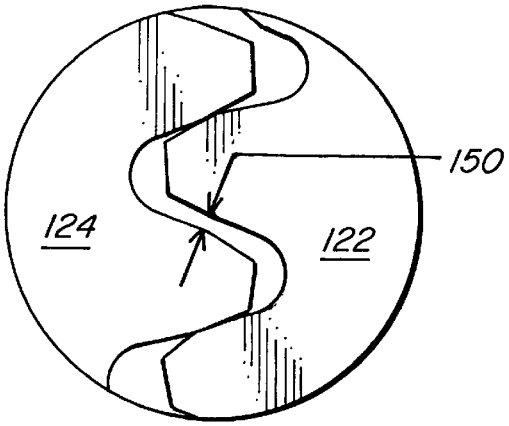
FIG. 5 is an enlarged localized view taken from FIG. 4 illustrating the timing gear adjustment.

Now referring to FIGS. 4 and 5, the female rotor timing gear 124 is then rotated in a clockwise direction until it stops. In this position, the leading flanks of the teeth of the male rotor timing gear 122 are in contact with the trailing flanks of the teeth of the female rotor timing gear 124 along the line of action of the gears (see FIG. 5). Backlash between the gears 124 and 122 is indicated at 150. At such a time, the several female rotor timing gear locking bolts 128 are tightened so that the female rotor timing gear 124 is fastened to the female rotor 106. Thereafter, the apparatus 10 of the subject invention is removed from the air intake end of the compressor 100.

After making the adjustment described above, the male rotor trailing flank 136 is set at the trailing flank clearance from the female rotor leading flank 142 (see FIG. 3). The accuracy of the setting will have depended on the accuracy of the adjusting apparatus, the accuracy of the measuring tool, and the care with which the adjusting procedure was followed.

The above steps describe the male to female rotor adjustment based on calculations determining the clearance between the male rotor trailing flank 136 and the female rotor leading flank 142. A person skilled in the art can readily understand that a similar calculation can be made to determine the clearance between the male rotor leading flank 134 and the female rotor trailing flank 144. In this later case, the steps outlined hereinabove would be followed up to and including the step when the male rotor 104 is locked in position with its trailing flanks 136 in contact with the female rotor 106 leading flanks 142. From that point, the steps described hereinbelow would be followed.

With reference to FIGS. 2 and 7, the total rotor backlash is obtained by observing the new reading from the dial indicator 68 as described hereinabove. The total rotor backlash is then multiplied by the decimal representing the percent of backlash desired between the male rotor leading flank 134 and the female rotor trailing flank 144, and the result noted by the technician. This number is referred to hereinafter as the 'leading flank clearance'.

Thereafter, the knurled locking bolt 48 threaded into the second locking bolt bracket 42 is loosened and the adjustment bar 52 rotated in a counter-clockwise direction until it stops. In this position, the leading flanks 134 of the male rotor 104 are in contact with the trailing flanks 144 of the female rotor 106. The male rotor 104 is then locked in this position by adjusting the knurled locking bolt 50 threaded into the lower threaded flange 17 of the second locking bolt bracket 42 against the bottom surface of the arm portion 56 of the adjusting bar 52. The dial indicator bezel 69 is then readjusted to a zero reading.

The lower knurled locking bolt 50 threaded onto the lower threaded flange 17 of the second locking bolt bracket 42 is then loosened and the upper knurled locking bolt 48 is slowly adjusted to cause the adjusting bar 52 to rotate in the clockwise direction. Adjustment of the upper knurled locking bolt 48 is complete when the dial indicator 68 reads the above calculated leading flank clearance. The lower knurled locking bolt 50 is then tightened so to retain the adjustment.

Now referring to FIGS. 4 and 5, the female rotor timing gear 124 is rotated in a clockwise direction until it stops. In this position, the leading flanks of the teeth of the male rotor timing gear 122 are in contact with the trailing flanks of the teeth of the female rotor timing gear 124 along the line of action of the gears (see FIG. 5). At such a time, the several female rotor timing gear locking bolts 128 are tightened so that the female rotor timing gear 124 is fastened to the female rotor 106. Thereafter, the apparatus 10 of the subject invention is removed from the air intake end of the compressor 100.

When the steps outlined above direct the technician to adjust the bezel to the zero reading, this should be read broadly to include the equivalent step of taking note of the indicator reading and using that reading as the datum. The later reading is then subtracted, or added as the case may be, from the subsequent reading to determine the movement of adjusting bar 52.

The preferred embodiment disclosed above describes a method and apparatus for adjusting the rotors of a screw compressor that has not been attached to a motor or air system. It is envisioned that the preferred embodiment of subject invention described above could be configured for use on a rotary screw compressor that has been previously attached to a motor and/or an air system. In such an instance, a technician would be able to more accurately and easily adjust and set the clearance between the rotors of a rotary screw compressor without having to disassemble the compressor from the motor and/or air system. In addition, a less experienced technician could make the adjustment due to the ease and simplicity of the method and apparatus of the invention, thereby saving time, reducing the possibility of damage to the equipment, and ultimately saving great expense.

While the invention has been described with respect to a preferred embodiment, those skilled in the art will readily appreciate that various changes and/or modifications can be made to the invention without departing from the spirit or scope of the invention as defined by the appended claims.

What is claimed is:

1. A rotor adjusting apparatus for adjusting flank clearance between the lands of meshing first and second rotors in a positive displacement screw machine, the apparatus comprising:

a) a base configured to mount proximate an end of the meshing first and second rotors in the positive displacement screw machine;

b) means supported by said base and operatively configured for locking the first rotor in a fixed position relative to said base;

c) means configured to attach to the second rotor for rotational adjustment thereof in relation to the first rotor to establish clearance between the land flanks of the meshing first and second rotors;

d) means configured for measuring rotational adjustment of said adjustment means in relation to said base; and e) means supported by said base and operatively configured for locking said adjustment means in a fixed position in relation to said base and, thereby, the second rotor in relation to the first rotor.

2. The rotor adjusting apparatus as recited in claim 1, wherein said first rotor locking means includes:

a) a bar configured to mount to the first rotor and having a surface extending tangent a distance from the axis of the first rotor;

b) a first locking bolt bracket fastened to said base and having a flange extending therefrom that is adjacent said bar, said flange including a threaded portion the axis of which extends perpendicular to the axis of the first rotor;

c) a locking bolt threadingly engaging said threaded portion of said flange and engageable with said bar surface.

3. The rotor adjusting apparatus as recited in claim 1, wherein said adjustment means includes a ring portion configured to mount to the shaft of the second rotor and further includes an arm portion depending radially therefrom, said arm portion having a surface extending tangential a distance from the axis of the second rotor.

4. The rotor adjusting apparatus as recited in claim 3, wherein said means for locking said adjustment means includes a second locking bolt bracket fastened to said base and having a flange extending therefrom that is adjacent said adjustment means arm portion, said flange includes a threaded portion the axis of which extends perpendicular to the axis of the second rotor, and a locking bolt threadingly engaging said threaded portion of said flange and engagable with said arm portion surface.

5. The rotor adjusting apparatus as recited in claim 1, wherein said measuring means includes at least one attachment member adjustably mounted to said base and a measuring tool adjustably mounted to said at least one attachment member.

6. The rotor adjusting apparatus as recited in claim 5, wherein said measuring tool is a precision measuring device capable of measuring within 0.0001 inch graduations.

7. A rotor adjusting apparatus for adjusting flank clearance between meshing first and second rotors of a positive displacement screw machine, the apparatus comprising:

a) a base attached to the positive displacement screw machine proximate an end of the meshing first and second rotors, said base having a surface approximately perpendicular to the axes of the rotors, a first aperture formed therein through which a shaft of the first rotor is accessible, and a second aperture formed therein through which a shaft of the second rotor is accessible;

b) means supported on said surface of said base and configured for fixedly locking the first rotor shaft in relation to said base;

c) means attached to the second rotor shaft for rotationally positioning the second rotor in relation to the first rotor, said means including a reference surface depending therefrom;

d) means in contact with said reference surface of said positioning means for measuring rotational position of said positioning means in relation to said base and, thereby, the rotational position of the second rotor in relation to the first rotor; and e) means supported on said surface of said base and configured for locking said positioning means in a fixed position in relation to said base;

whereby rotational positioning of said positioning means causes said measuring means to quantify the relative position between the second rotor and first rotor and said means for locking said positioning means locks said second rotor in a predetermined relative position.

8. The rotor adjusting apparatus as recited in claim 7, wherein said first rotor locking means includes:

a) a bar configured to mount to the first rotor shaft and having a surface tangent a distance from the axis of the first rotor;

b) a first locking bolt bracket fastened to said surface of said base and having a flange extending therefrom that is adjacent said bar, said flange including a threaded portion the axis of which extends perpendicular to the axis of the first rotor;

c) a locking bolt threadingly engaging said threaded portion of said flange and engageable with said surface of said bar.

9. The rotor adjusting apparatus as recited in claim 7, wherein said positioning means includes a ring portion configured to mount to the second rotor shaft and further includes an arm portion depending radially therefrom and having a surface extending tangent a distance from the axis of the second rotor.

10. The rotor adjusting apparatus as recited in claim 9, wherein said means for locking said positioning means includes:

a second locking bolt bracket fastened to said surface of said base and having a flange extending therefrom that is adjacent said arm portion, said flange includes a threaded portion the axis of which extends perpendicular to the axis of the second rotor, and a locking bolt threadingly engaging said threaded portion of said flange and engagable with said arm portion surface.

11. The rotor adjusting apparatus as recited in claim 7, wherein said measuring means includes at least one attachment member adjustably mounted to said surface of said base and a measuring tool adjustably mounted to said at least one attachment member.

12. The rotor adjusting apparatus as recited in claim 11, wherein said measuring tool is a precision measuring device capable of measuring within 0.0001 inch graduations.

13. A method of adjusting flank clearance between first and second rotors of a positive displacement screw machine, the screw machine being of the type including a casing enclosing the rotors and a timing mechanism to maintain the rotational relationship between the rotors, the method comprising the steps of:

a) disengaging the rotor timing mechanism associated with the first and second rotors so the rotational relationship is adjustable;

b) locking the first rotor in a fixed position in relation to the screw machine to prevent axial rotation thereof;

c) determining a measurement corresponding to total rotor backlash between the rotors by rotating the second rotor through the total backlash movement and measuring the movement at a point external to the screw machine casing;

d) calculating a measurement corresponding to desired flank clearance based on the measurement corresponding to total rotor backlash;

e) adjusting the second rotor in relation to the first rotor to the measurement corresponding to desired flank clearance; and f) engaging the rotor timing mechanism associated with the first and second rotors to preserve the flank clearance adjustment.

14. The method of adjusting flank clearance as recited in claim 13, wherein said step of locking the first rotor in a fixed position includes the steps of:

attaching a bar to a shaft of the first rotor at a point external to the screw machine casing; and locking the bar in a fixed position in relation to the screw machine to prevent axial rotation thereof.

15. The method of adjusting flank clearance as recited in claim 13, wherein said step of determining the measurement corresponding to total rotor backlash between the rotors includes the steps of:

a) rotating the second rotor in a first direction until the flanks of the second rotor come into contact with the flanks of the first rotor;

b) adjusting the position of a measuring tool that is operatively associated with the screw machine so that the measuring tool probe makes contact with a surface of the second rotor, the surface moving angularly with the rotation of the rotor;

c) adjusting the measuring tool to establish a datum;

d) rotating the second rotor in a second direction opposite the first direction until the flanks of the second rotor come into contact with the flanks of the first rotor; and e) recording the measurement from the measuring tool corresponding to total rotor backlash between the first and second rotors.

16. The method of adjusting flank clearance as recited in claim 13, wherein said step of calculating the measurement corresponding to desired flank clearance includes the step of multiplying the measurement corresponding to total rotor backlash by a number as specified by the screw machine manufacturer.

17. The method of adjusting flank clearance as recited in claim 13, wherein said step of adjusting the second rotor in relation to the first rotor to the measurement corresponding to desired flank clearance includes the steps of:

a) rotating the second rotor in a first direction until the flanks of the second rotor come into contact with the flanks of the first rotor;

b) adjusting the position of a measuring tool that is operatively associated with the screw machine so the measuring tool probe makes contact with a surface of the second rotor and external to the screw machine casing, the surface moving angularly with the rotation of the rotor;

c) adjusting the measuring tool to establish a datum; and d) rotating the second rotor in a direction opposite the first direction until the measurement indicated by the measuring tool corresponds to the desired flank clearance.

18. A method of adjusting screw rotors of a positive displacement screw machine, the screw machine including first and second mating rotors rotatable about respective rotor shafts, a rotor casing enclosing the rotors, a first timing attachment adjustingly engaged with the first rotor, and a second timing attachment adjustingly engaged with the second rotor, whereby the first and second timing attachments mutually associate to cause the rotors to rotate synchronously, said method comprising the steps of:

a) disengaging at least one of the two rotor timing attachments associated with the first and second rotors;

b) locking the first rotor in a fixed position in relation to the rotor casing to prevent axial and rotational movement thereof;

c) determining a measurement corresponding to total rotor backlash between the rotors by rotating the second rotor through the total backlash movement and measuring the movement at a reference point on the second rotor located external to the rotor casing;

d) calculating a measurement corresponding to desired flank clearance based on the measurement corresponding to total rotor backlash;

e) adjusting the second rotor in relation to the first rotor to the measurement corresponding to the desired flank clearance, the measurement being taken at the reference point on the second rotor located external to the rotor casing; and f) engaging the at least one of two rotor timing attachments associated with the first and second rotors to maintain the flank clearance adjustment.

19. The method of adjusting screw machine rotors as recited in claim 18, wherein said step of locking the first rotor in a fixed position includes the steps of:

attaching a bar to the end of the first rotor shaft at a point external to the rotor casing; and locking the bar in a fixed position to prevent axial and rotational movement thereof.

20. The method of adjusting screw machine rotors as recited in claim 18, wherein said step of determining the measurement corresponding to total rotor backlash between the rotors includes the steps of:

a) rotating the second rotor in a first direction until the flanks of the second rotor come into contact with the flanks of the first rotor;

b) adjusting the position of a measuring tool that is operatively associated with the screw machine so that the measuring tool probe makes contact with the reference point on the second rotor, the point moving angularly with the rotation of the rotor;

c) adjusting the measuring tool to establish a datum;

d) rotating the second rotor in a second direction opposite the first direction until the flanks of the second rotor come into contact with the flanks of the first rotor; and e) recording the measurement from the measuring tool corresponding to total rotor backlash between the first and second rotors.

21. The method of adjusting screw machine rotors as recited in claim 18, wherein said step of calculating the measurement corresponding to desired flank clearance includes the step of multiplying the measurement corresponding to total rotor backlash by a number as specified by the screw machine manufacturer.

22. The method of adjusting screw machine rotors as recited in claim 18, wherein said step of adjusting the second rotor in relation to the first rotor to the measurement corresponding to desired flank clearance includes the steps of:

a) rotating the second rotor in a first direction until the flanks of the second rotor come into contact with the flanks of the first rotor;

b) adjusting the position of a measuring tool that is operatively associated with the screw machine so the measuring tool probe makes contact with the reference point on the second rotor, the point moving angularly with the rotation of the rotor;

c) adjusting the measuring tool to establish a datum; and d) rotating the second rotor in a direction opposite the first direction until the measurement indicated by the measuring tool corresponds to the desired flank clearance.

* * * * *